US011377246B2

(12) United States Patent
Menear et al.

(10) Patent No.: US 11,377,246 B2
(45) Date of Patent: Jul. 5, 2022

(54) AUTO-FEED ASSEMBLY FOR MODULAR FILLING SYSTEMS

(71) Applicant: Liqui-Box Corporation, Richmond, VA (US)

(72) Inventors: Tad Menear, Bridgeton, NJ (US); John Woodhouse, Santa Ana, CA (US); John. J. Hildebrand, Corona, CA (US)

(73) Assignee: LIQUI-BOX CORPORATION, Richmond, VA (US)

( * ) Notice: Subject to any disclaimer, the term of this patent is extended or adjusted under 35 U.S.C. 154(b) by 424 days.

(21) Appl. No.: 16/592,385

(22) Filed: Oct. 3, 2019

(65) Prior Publication Data

US 2020/0108962 A1 Apr. 9, 2020

Related U.S. Application Data

(60) Provisional application No. 62/740,594, filed on Oct. 3, 2018, provisional application No. 62/740,540, filed on Oct. 3, 2018.

(51) Int. Cl.
*B65B 43/54* (2006.01)
*B65B 43/28* (2006.01)
(Continued)

(52) U.S. Cl.
CPC ..... *B65B 43/54* (2013.01); *B65B 43/12* (2013.01); *B65B 43/28* (2013.01); *B65B 43/465* (2013.01);
(Continued)

(58) Field of Classification Search
CPC ..... B65B 43/54; B65B 43/12; B65B 43/28; B65B 43/465; B65B 43/46; B65B 43/59;
(Continued)

(56) References Cited

U.S. PATENT DOCUMENTS 3,516,220 A * 6/1970 Buford ..... B65B 3/28 53/502
4,283,901 A * 8/1981 Schieser ..... B65B 43/60 53/272
(Continued)

FOREIGN PATENT DOCUMENTS

CN 207917287 U 1/2009
JP 09-039908 A 1/2009

OTHER PUBLICATIONS

Machine translation of JP 09-039908, Noguchi Works Co, Ltd; Jan. 22, 2009; all pages (Year: 2009).*
(Continued)

*Primary Examiner* — Nicolas A Arnett
(74) *Attorney, Agent, or Firm* — McAndrews, Held & Malloy, Ltd.

(57) ABSTRACT

An adjustable table assembly for use in a filler assembly includes a table having a top surface configured to receive a flexible container thereon and a clamp disposed on the table and configured to releasably secure the flexible container to the table. The table has an infeed end and an outfeed end opposite the infeed end. The table is movable along a plurality of rails affixed to the filler assembly. The table is movable between a loading position, in which the table is configured to receive the flexible container, and an operating position, in which the table is inside the filler assembly. The movement of the table along the plurality of rails is along a first axis. Filler assemblies and methods of using adjustable table assemblies are also disclosed.

22 Claims, 12 Drawing Sheets

(51) Int. Cl.

| | |
|---|---|
| ***B65B 43/12*** | (2006.01) |
| ***B65B 43/46*** | (2006.01) |
| ***B65B 67/04*** | (2006.01) |
| ***B65B 67/12*** | (2006.01) |
| *B65B 3/04* | (2006.01) |

(52) U.S. Cl.
CPC ..... *B65B 67/04* (2013.01); *B65B 67/1211* (2013.01); *B65B 67/1233* (2013.01); *B65B 3/04* (2013.01)

(58) Field of Classification Search
CPC ..... B65B 43/00; B65B 3/04; B65B 67/04; B65B 67/1211; B65B 67/1233
See application file for complete search history.

(56) References Cited

U.S. PATENT DOCUMENTS 4,297,929 A * 11/1981 Schieser ..... B26D 1/095 225/104
4,386,636 A * 6/1983 Ellert ..... B65B 43/123 141/10
4,620,411 A 11/1986 Schieser et al.
4,676,285 A * 6/1987 Schieser ..... B65B 43/123 141/114
4,733,517 A * 3/1988 Araki ..... B29C 66/843 141/126
5,664,399 A * 9/1997 Cassou ..... A61D 19/022 53/284.7
5,690,151 A * 11/1997 Rutter ..... B65B 39/00 134/166 R
7,380,575 B2 * 6/2008 Stricklin ..... B65B 3/045 141/10
7,611,102 B2 * 11/2009 Murray ..... B65B 43/465 141/391
8,511,048 B2 * 8/2013 Smith ..... B65B 43/52 53/575
8,707,663 B2 * 4/2014 Matheyka ..... B65B 59/003 53/570
8,720,498 B2 * 5/2014 Martin ..... G21F 9/04 141/86
2007/0137727 A1 * 6/2007 Stricklin ..... B65B 3/045 141/114
2009/0020181 A1 1/2009 Martin
2020/0108966 A1 * 4/2020 Menear ..... B65B 9/12

OTHER PUBLICATIONS

PCT, Notification Concerning Transmittal of International Preliminary Report on Patentability, in Application No. PCT/US2019/054455, dated Apr. 15, 2021 (10 pages).

* cited by examiner

AUTO-FEED ASSEMBLY FOR MODULAR FILLING SYSTEMS

CROSS REFERENCE TO RELATED APPLICATIONS

This application claims the benefit of U.S. Provisional Application No. 62/740,594, filed Oct. 3, 2018, and U.S. Provisional Application No. 62/740,540, filed Oct. 3, 2018, the entireties of which are incorporated herein for any and all purposes.

TECHNICAL FIELD

This disclosure generally relates to devices and methods of filling flexible containers with flowable materials, and more particularly relates to adjustable and automated assemblies for introducing flexible containers into filler assemblies.

BACKGROUND

Liquid filling and packaging requires many different steps and separate components. Depending on the desired setup, the process from start to finish can include preparing the liquid, preparing the packaging, moving the liquid into the package, and sealing the package with the liquid therein, as well as other steps, such as sterilizing, labeling, and organizing the packaging with liquid for storage or transportation. Each component responsible for any of the necessary steps must be maintained, serviced, and prepared such that it can work with each of the other related components. As more components are introduced into a system, more control is necessary to ensure proper interaction between all of the components to prepare the final product. Additionally, the assembly-line-type structure of the system often requires a specific order of processes. Such requirements result in needing multiple large machines and inconvenient component setups. It is often difficult to change one or more components in such systems in order to prepare a different product. Similarly, components are difficult to remove or replace. As such, it is desirable to have an assembly system that can operate with different interchangeable components that can be organized as necessary.

There are shortcomings with the conventional assemblies. Flexible containers have to be introduced into the filler machines by operators who have to manually place the flexible containers therein and to orient the flexible containers in the desired position. The flexible containers have to be maintained in the proper orientation and position, as well as kept flat and not creased or folded, during operation of the filler assembly. The operators have to reach into the assembly to position, adjust, and maintain the flexible container, which increases risk of injury and requires longer preparation times and more operators for the necessary operation. Therefore, there is a need for improved assemblies to automate the process of placement of flexible containers and maintaining them in the needed positions.

SUMMARY

The foregoing needs are met by various aspects of adjustable table assemblies disclosed. According to an aspect of the disclosure, an adjustable table assembly for use in a filler assembly includes a table having a top surface configured to receive a flexible container thereon and a clamp disposed on the table and configured to releasably secure the flexible container to the table. The table has an infeed end and an outfeed end opposite the infeed end. The table is movable along a plurality of rails affixed to the filler assembly. The table is movable between a loading position, in which the table is configured to receive the flexible container, and an operating position, in which the table is inside the filler assembly. The movement of the table along the plurality of rails is along a first axis.

Optionally, the adjustable table assembly may further include a slot defined on the top surface of the table, the slot being configured to receive the flexible container therein. The clamp may be disposed adjacent to the slot and is configured to releasably secure the flexible container in the slot.

Further optionally, the flexible container may be a bag having a spout extending therefrom.

The top surface may define a dimpled textured thereon.

The clamp may have an open configuration, in which the flexible container is not secured therein, and a closed configuration, in which the flexible container is secured in the clamp. The clamp may include a first clamping side, a second clamping side opposite the first clamping side, and an actuator. The actuator may be configured to move at least one of the first and second clamping sides towards the other of the first and second clamping sides when the clamp is moved into the closed configuration, and away from the other of the first and second clamping sides when the clamp is moved into the open configuration. The first clamping side and the second clamping side each may include an elastic layer thereon, the elastic layers on each of the first and second clamping sides being configured to contact the flexible container when the clamp is in the closed configuration.

The adjustable table assembly may optionally further include a height adjustment assembly configured to be actuated to move the table along a second axis that is perpendicular to the first axis. The height adjustment assembly may include a plurality of first heads fixedly attached to the table, a plurality of second heads fixedly attached to the plurality of rails, and a connector attached to both the first and second heads. The connector may be configured to be moved such that the first and second head are movable closer to each other or farther from each other.

In some aspects, the table may define a front face at the infeed end, the front face being connected to the top surface at an edge. In some aspects, the front face may be rounded. In some aspects, the edge may be rounded to have a curvature radius of between 0.25 inches and 5 inches. In some aspects, the curvature radius may be between 0.5 inches and 4 inches. In some aspects, the curvature radius may be between 1 inch and 3 inches. In some aspects, the curvature radius may be 2 inches.

The clamp may be disposed closer to the outfeed end of the table than to the infeed end.

The adjustable table assembly may further include an adjustable rail assembly configured to guide the flexible container along the table. The adjustable rail assembly may include two parallel rails that define a space therebetween, the space being configured to receive the flexible container therein. The adjustable rail assembly may be configured to change the space between the two parallel rails, wherein at least one of the two parallel rails may be configured to be moved to change the dimensions of the space between the two parallel rails.

According to another aspect, a method of feeding a flexible container into a filler assembly using an adjustable table assembly having a table and a clamp includes the steps of moving the table along a first axis in a first direction into a predetermined loading position; introducing the flexible container at an infeed end of the table and onto a top surface defined on the table; securing the flexible container in a clamp disposed on the adjustable table assembly; and moving the table along the first axis in a second direction opposite the first direction and into a predetermined operating position.

Optionally, the method may further include the step of moving the flexible container into a slot defined on the top surface of the table.

The method may further include moving the table along a second axis perpendicular to the first axis when the table is in the predetermined loading position.

The method may further include actuating operation of the filler assembly after moving the table into the predetermined operating position.

The method may further include positioning at least one safety guard adjacent to the adjustable table assembly after moving the table into the predetermined operating position.

According to another aspect of the disclosure, a filler assembly for moving a flowable material into a flexible container may include an adjustable table assembly. The adjustable table assembly for use in a filler assembly includes a table having a top surface configured to receive a flexible container thereon and a clamp disposed on the table and configured to releasably secure the flexible container to the table. The table has an infeed end and an outfeed end opposite the infeed end. The table is movable along a plurality of rails affixed to the filler assembly. The table is movable between a loading position, in which the table is configured to receive the flexible container, and an operating position, in which the table is inside the filler assembly. The movement of the table along the plurality of rails is along a first axis.

The adjustable table assembly in the filler assembly may further include a slot defined on the top surface of the table, the slot being configured to receive the flexible container therein. The clamp may be disposed adjacent to the slot and is configured to releasably secure the flexible container in the slot. The flexible container may be a bag having a spout extending therefrom. The top surface may define a dimpled textured thereon. The clamp may have an open configuration, in which the flexible container is not secured therein, and a closed configuration, in which the flexible container is secured in the clamp. The clamp may include a first clamping side, a second clamping side opposite the first clamping side, and an actuator. The actuator may be configured to move at least one of the first and second clamping sides towards the other of the first and second clamping sides when the clamp is moved into the closed configuration, and away from the other of the first and second clamping sides when the clamp is moved into the open configuration. The first clamping side and the second clamping side each may include an elastic layer thereon, the elastic layers on each of the first and second clamping sides being configured to contact the flexible container when the clamp is in the closed configuration.

The adjustable table assembly in the filler assembly may optionally further include a height adjustment assembly configured to be actuated to move the table along a second axis that is perpendicular to the first axis. The height adjustment assembly may include a plurality of first heads fixedly attached to the table, a plurality of second heads fixedly attached to the plurality of rails, and a connector attached to both the first and second heads. The connector may be configured to be moved such that the first and second head are movable closer to each other or farther from each other. In some aspects, the table may define a front face at the infeed end, the front face being connected to the top surface at an edge. In some aspects, the front face may be rounded. In some aspects, the edge may be rounded to have a curvature radius of between 0.25 inches and 5 inches. In some aspects, the curvature radius may be between 0.5 inches and 4 inches. In some aspects, the curvature radius may be between 1 inch and 3 inches. In some aspects, the curvature radius may be 2 inches. The clamp may be disposed closer to the outfeed end of the table than to the infeed end.

The adjustable table assembly in the filler assembly may further include an adjustable rail assembly configured to guide the flexible container along the table. The adjustable rail assembly may include two parallel rails that define a space therebetween, the space being configured to receive the flexible container therein. The adjustable rail assembly may be configured to change the space between the two parallel rails, wherein at least one of the two parallel rails may be configured to be moved to change the dimensions of the space between the two parallel rails.

BRIEF DESCRIPTION OF THE DRAWINGS

The present application is further understood when read in conjunction with the appended drawings. For the purpose of illustrating the subject matter, there are shown in the drawings exemplary aspects of the subject matter; however, the presently disclosed subject matter is not limited to the specific methods, devices, and systems disclosed. In the drawings.

Aspects of the disclosure will now be described in detail with reference to the drawings, wherein like reference numbers refer to like elements throughout, unless specified otherwise.

DETAILED DESCRIPTION OF ILLUSTRATIVE EMBODIMENTS

Figure 1:
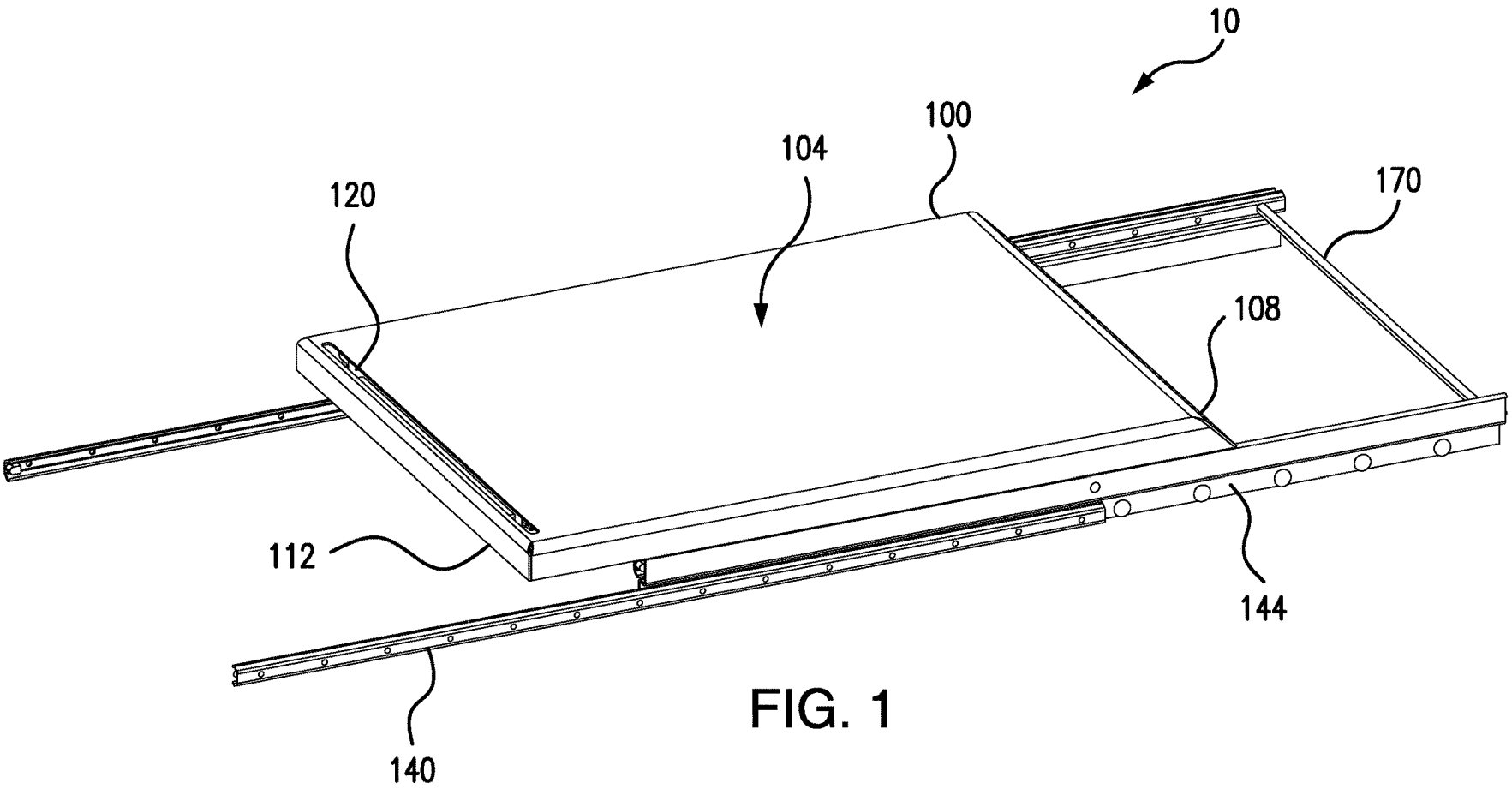
FIG. 1 depicts an isometric perspective view of an adjustable table assembly according to an aspect of the disclosure.
Figure 2:
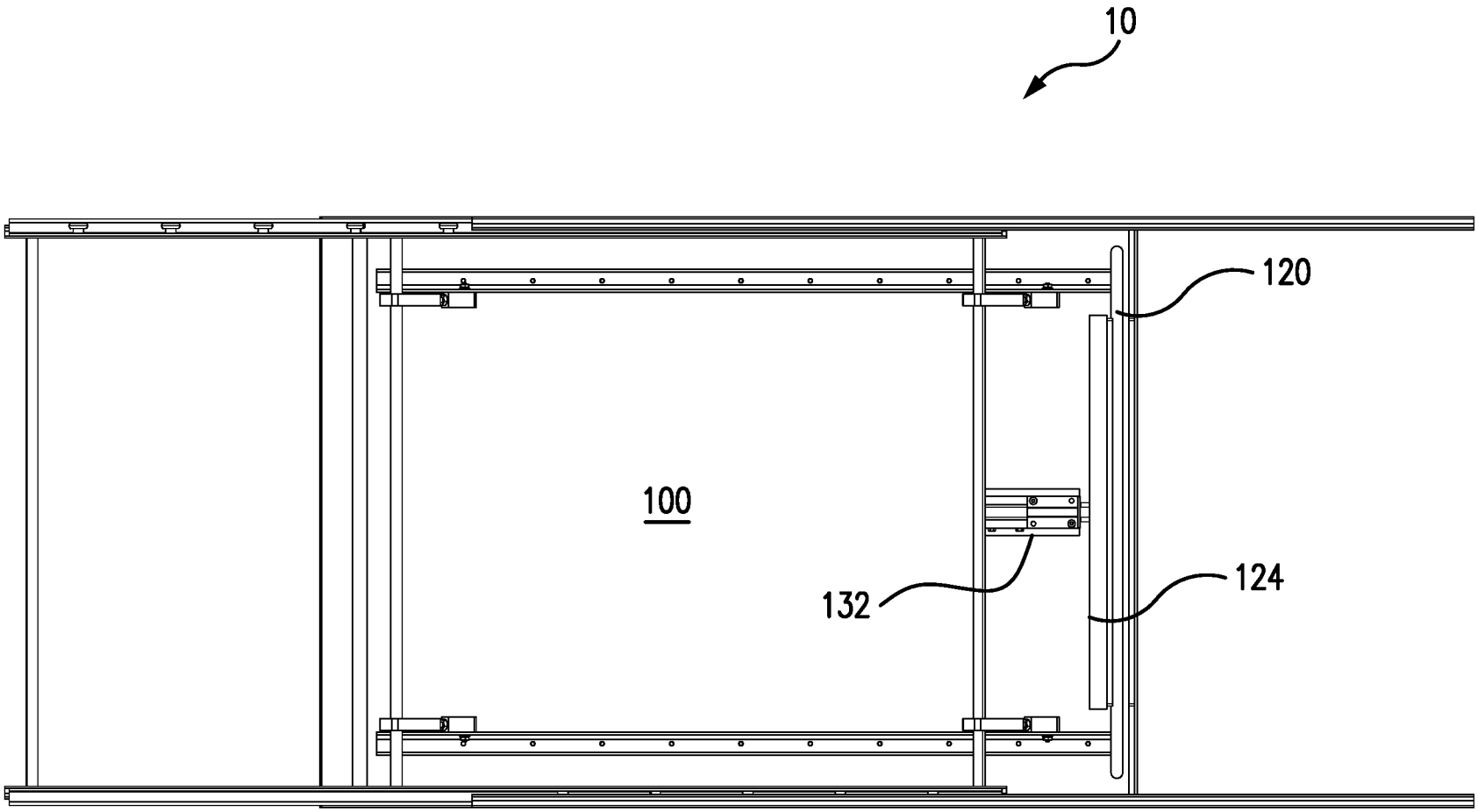
FIG. 2 depicts a bottom perspective view of the adjustable table assembly of FIG. 1.
Figure 3:
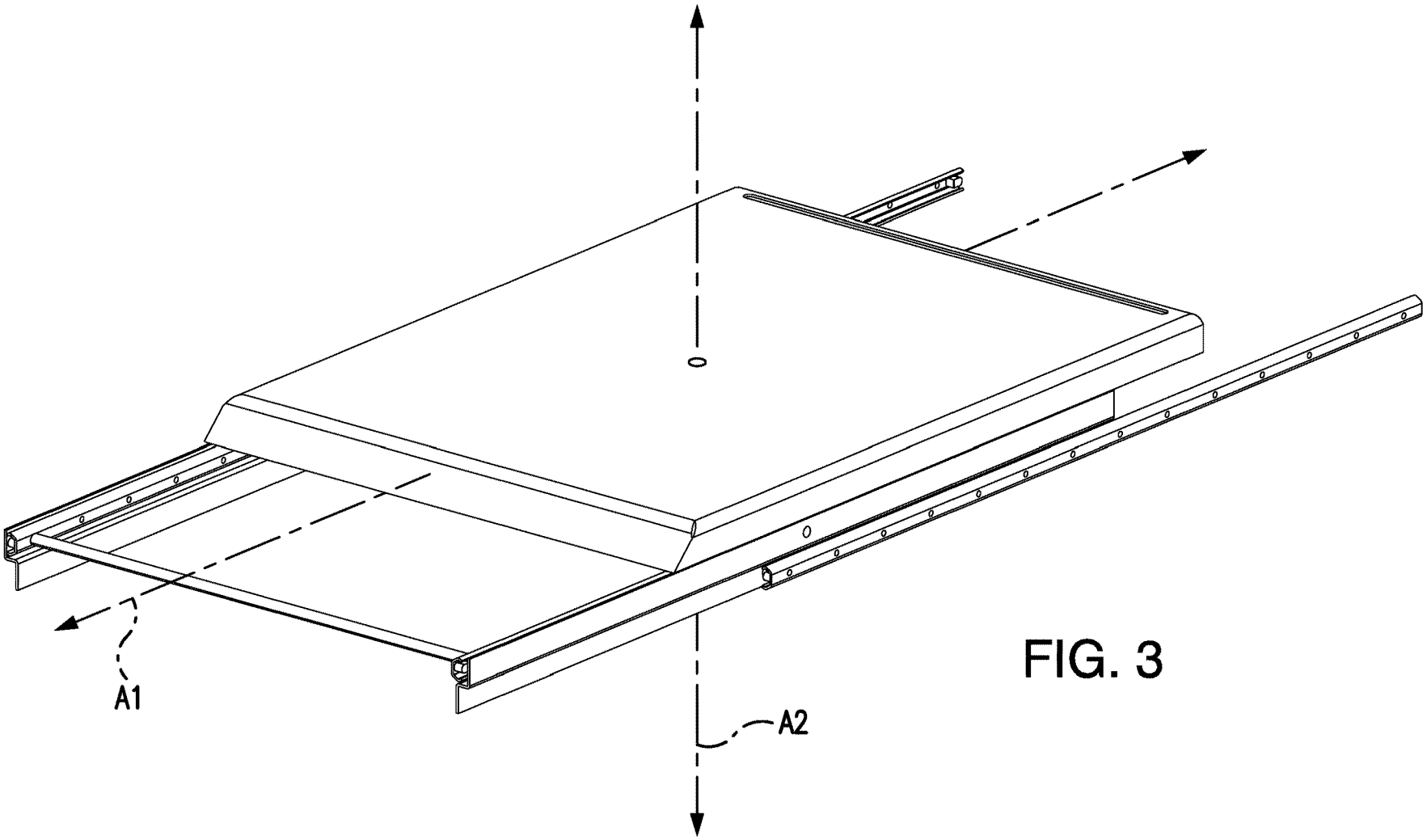
FIG. 3 depicts another isometric perspective view of the adjustable table assembly of FIGS. 1 and 2.

Filler assemblies are used with flowable substances and flexible containers, such as bags. The filler assemblies can form, fill, seal, and/or prepare the bags for shipment. It will be appreciated that the same filler assembly can be utilized for one or more of the above steps, or, alternatively, separate filler assemblies can be used that are responsible for different stages of the process.

The filler assemblies should be designed to use as many components that are used in filling processes as possible. The filler assembly can be operated with a wide range of pouch sizes, spouts and caps, fill orientations, and various loading methods, such as side loading, flat drop, spout trailing, spout leading, and front and rear discharge. A filling area should be designed to handle a variety of filling requirements, such as ambient fill, ESL, Aseptic, Hot-fill, and other suitable filling concepts. The components present in the filler assembly allow for modularity of design, quick changeover and adjustments, and tool-less design considerations.

The filler assembly can operate with a wide range of suitable products and processing protocols. Suitable products include, but are not limited to, wine, syrup, water, carbonated beverages, other beverages, and industrial products. It will be under stood that the filling and production rate will depend on the product type, the fitment size, the specific components within the assembly, and other parameters of the filler machine assembly.

Depending on the specific arrangement of the filler assembly, the assembly may operate at different filling rates, for example, at 10 to 200 gallons per minute (GPM), at 40 to 150 GPM, at 60 to 100 GPM, at 80 to 90 GPM, or at another suitable range of filling rates. The assembly can be designed to fill the desired number of bags at different rates that can be adjusted based on the product, bag size, and other components in the assembly. In some aspects, the machine can fill 1-gallon bags at a rate of at least 10 bags per minute (BPM), preferably at least between 12 and 14 BPM. For 2.5-gallon bags, the assembly may be designed to fill the bags at a rate of at least between 10 and 12 BPM. For 5-gallon bags, the assembly may be designed to fill the bags at a rate of at least between 8 and 10 BPM. It will be understood that it will be preferable to achieve higher filling rates where possible without sacrificing quality or elimination necessary steps.

The filler assembly may utilize any suitable flow meter to measure the flow of the product being introduced into the bags.

While any suitable materials can be used to manufacture the filler assembly, it will be appreciated that the assembly should withstand repetitive use and be easily serviced, cleaned, and sterilized. A frame of the assembly may be constructed of a metal, such as stainless steel. In some aspects, the frame includes 304 stainless steel. The frame may include non-metal components, which should be approved for use in food applications.

The assembly may include various components for preparing a bag with a product therein. The assembly may include an inlet for the bag and/or product, a bag separator, a bag loader, a filling head, a capping assembly, and a suitable exit for the final product out of the assembly.

In existing filler systems, a flexible container (e.g., a bag to be filled with a product) is introduced into the filler machine and is moved through the various components until it engages with a pusher assembly that moves the flexible container further through the system. However, this requires passing the flexible container under the product filler in the modular filler assembly. This is difficult because this requires maneuvering the flexible container around various components. The bag has to be manually inserted into the machine, properly positioned and oriented, and then pulled/pushed manually until the bag is in the desired filling position.

To achieve this, the operator (or operators) have to access the interior of the filler assembly during the loading and feeding process. This increases the risk of injury as the operators place their limbs into the assembly and in proximity to moving components during operation. Since the operators have to access the interior of the assembly, any protective covers or safety guards have to be removed, disabled, or be generally absent, which further increases chances of injury. The manual insertion, positioning, and movement of the bag also leads to inconsistencies between different loads due to the human factor, user error, differences in trainings, and capabilities of different operators. The entire manual process also requires more time to achieve, as well as more operators to do it.

The adjustable table assemblies disclosed herein allow for more automation during loading to increase safety, efficiency, and consistency during the loading process. Referring to FIGS. 1-11, an adjustable table assembly 10 is disclosed. The adjustable table assembly 10 includes a table 100 configured to receive a bag 1 thereon. The table 100 includes a top surface 104 configured to contact the bag 1. The top surface 104 may be substantially planar. In some aspects, the top surface 104 may be substantially smooth to prevent the bag 1 from catching on the table 100 or from otherwise ripping or deforming. In some aspects, the top surface 104 may be "rigidized" to define a texture or pattern 106, such as ridges, bumps, dimples, or another suitable pattern. Such a texture or pattern 106 may help prevent the bag 1 from sticking to the top surface 104 due to static adhesion or surface-to-surface interaction between the smooth bag 1 and the smooth top surface 104. The texture or pattern 106 may provide enough of a physical break along the contact points between the top surface 104 and the bag 1 to allow the bag 1 to lie substantially flat on the top surface 104 while preventing it from adhering thereto. The table 100 may be constructed from stainless steel.

The table 100 is configured to receive the bag 1 from an infeed end 108. An operator (not shown) can introduce the bag 1 at the infeed end 108 onto the top surface 104 of the table 100. The bag 1 can be moved along the top surface 104 from the infeed end 108 towards an outfeed end 112 opposite the infeed end 108. The infeed end 108 may include a front face 116 that is connected with the top surface 104 at an edge 118.

The front face 116 may be substantially planar or, in some aspects, the front face 116 may be curved. The edge 118 may also be curved or beveled such as to avoid a sharp corner edge. In some aspects, the edge 118 may have be rounded to have a curvature radius of between about 0.25 in and about 5 in, between about 0.5 in and about 4 in, between about 1 in and about 3 in, or another suitable range or combination of above ranges. In some aspects, the edge 118 may have a curvature radius of about 2 in. In some aspects, the front face 116 may comprise the curvature radius of the edge 118. The curvature of the edge 118 and/or the front face 116 may prevent the bag 1 from catching on a sharp corner of the table 100, thus decreases the chances of damage to the bag. Such a front face 116 and/or edge 118 may also allow for the bag 1 to be flattened and/or to remain flat during the feeding process due to the edge 118 being in contact with the bag 1 across the entire width of the bag 1 during the feeding step.

As the flexible bag 1 is fed onto the table 100, the flexible nature of the bag 1 may lead to wrinkling or folding of the bag 1, or another deformation of the bag 1. This is often not desirable because if the bag is not kept flat, the orientation of the bag 1 may change during the feeding process, the bag 1 can catch on other components and sustain rips or other damage, and/or the bag 1 may be improperly filled by the filling assembly. Furthermore, due to the automated nature of the feeding process, after the bag 1 has been introduced to the table 100, the filling assembly automatically moves the bag 1 along the top surface 104 towards the filling components. This requires each bag 1 to be in the same proper orientation when it is on the top surface 104 so that the filling assembly may properly automate the movement of the bag 1.

In some aspects, a plurality of bags 1 are fed onto the adjustable table assembly 10. Each of the plurality of bags 1 may be removably connected to an adjacent bag 1, for example, along a perforated boundary (not shown) that is configured to be severed during the forming and filling process. The plurality of bags 1 may be disposed in a known arrangement, for example, in folded sheets or in rolls. When the plurality of bags 1 are fed onto the table 100, it may be even more advantageous to keep the bags 1 flat along the top surface 104 or to flatten them and orient them properly if they are not flat and oriented as necessary when they are introduced.

The structure at the infeed end 108 described above facilitates in maintaining the proper orientation of the bags 1 and keeping them flat, as well as helping to orient, flatten, and generally correct the positioning of the bags 1 when introduced as a plurality of bags 1, such as from a set of sheets or a roll. The front face 116 and/or the edge 118 provide a physical baffle that may be contacted by the bags 1 as they are fed at the infeed end 108 and moved to the top surface 104 of the table 100. The flexible bags 1 contact and slide along and over the front face 116 and/or the edge 118 and are flattened or kept flat by the physical interaction with the front face 116 and/or the edge 118.

In existing arrangements, another component (e.g. a pusher or another weight) may hold the bags 1 flat and in the desired orientation as the operators manually move the bag 1 along the table. The features described above provide a more efficient solution to positioning the bags 1.

The table 100 includes a mechanism for releasably fixing the bag 1 thereto. This prevents the bag 1 from being dislodged during the feeding process after the operator finishes placing the bag 1 onto the table 100. Referring to FIGS. 1-4, the table 100 may define an opening therethrough configured to receive the bag 1 therein. The opening may be a slot 120 defined on the top surface 104. Although the slot 120 may be positioned at any portion of the top surface 104 depending on the type of bag and desired use, in some preferred aspects, the slot 120 is closer to the outfeed end 112 than to the infeed end 108. The slot 120 should be dimensioned such that at least a portion of the bag 1 may fir therein. For example, the slot 120 should be at least as wide as the widest bag 1 that can be used with the adjustable table assembly 10 and at least as long (measured orthogonally to the width) as the thickness of the thickest bag 1 that can be used. The slot 120 may be a through-hole that extends from the top surface 104 all the way through the table 100, or, alternatively, the slot 120 may be a blind bore that is open at the top surface 104 but does not extend all the way through the table 100.

A fixing mechanism configured to releasably hold the bag 1 in the slot 120 may be disposed in the adjustable table assembly 10, for example, on the table 100. The fixing mechanism may be a clamp 124. Referring to the exemplary aspect shown in FIGS. 2 and 4, the clamp 124 may include a first clamping side **124*a* and a second clamping side 124*b* opposite the first clamping side 124*a*. The clamp 124 has an open configuration, in which the first and second clamping sides 124*a*, 124*b* are spaced apart from each other, and a closed configuration, in which the first and second clamping sides 124*a*, 124*b* contact one another. In some aspects, when the clamp 124 is moved from the open to the closed configuration, one of the first and the second clamping sides 124*a*, 124*b* may be moved towards the other of the first and second clamping sides 124*a*, 124*b* to contact the other of the first and second clamping sides 124*a*, 124*b*. In some aspects, both the first and second clamping sides 124*a*, 124*b* may be moved towards one another and contact one another to place the clamp 124 in the closed configuration. To toggle the clamp 124 into the open configuration from the closed configuration, the first, second, or both clamping sides 124*a*, 124*b* may be moved in the opposite direction as when moving to the closed configuration, such that the first and second clamping sides 124*a*, 124*b*** do not contact one another.

The clamp 124 may include an actuator 132 configured to move the clamp 124 between the open and closed configurations. The actuator 132 may be a piston cylinder or another suitable actuating mechanism configured to push and/or pull one of the first and second clamping sides **124*a*, 124*b*. In some aspects, a plurality of actuators 132 may be present, for example, one actuator to move the first clamping side 124*a* and another actuator to move the second clamping side 124*b***.

The first, second, or both of the first and second clamping sides **124*a*, 124*b* may include an elastic layer 128 thereon to contact the bag 1 when the bag 1 is in the slot 120. The elastic layer 128 may include rubber. The increased friction between the elastic layer 128 and the bag 1 helps retain the bag 1 within the clamp 124 and the slot 120. Additionally, the elastic layer 128 is softer than the material of the first and second clamping sides 124*a*, 124*b*, and thus decreases wear on the bag 1 and prevents ripping or unnecessary crushing of the bag 1 in the clamp 124**.

When the bag 1 is introduced into the slot 120, the clamp 124 may be actuated to move to the closed configuration to secure the bag 1 between the first and second clamping sides **124*a*, 124*b*. The actuation of the clamp 124 may be manual (e.g. the operator may move the clamping sides into the closed position via a lever, button, or another tool) or automatic (e.g. the adjustable table assembly 10 may detect the bag 1 inside the slot 120 and cause the clamp 124 to move into the closed configuration). When the bag 1 has been fed into the assembly and needs to be moved further along the table 100, the clamp 124 is moved into the open configuration, thus releasing the bag 1. The bag 1 can then exit the slot 120 as the bag 1** is moved.

Releasably fixing the bag 1 in the slot 120 allows for the bag 1 to remain in the desired orientation along the top surface 104 as the adjustable table assembly 10 is being used. If no fixing mechanism is present, the bag 1 can move out of alignment. This can lead to the assembly failing to move the bag therethrough, the bag 1 can get caught in other components and get ripped or damaged, the bag 1 may fold or wrinkle, and/or the filling process may be hindered.

Although the figures depict a slot 120, it will be appreciated that the adjustable table assembly 10 may be designed without a slot 120 and simply have a clamp 124 that, when closed, has a clamping side that contacts the top surface 104 of the table 100, thus securing the bag 1 thereto. However, the disclosed aspects may offer advantages over such existing clamping technologies because, as disclosed, the bag 1 is clamped away from the top surface 104, thus keeping the top surface 104 substantially flat and free from clamping components. If a clamp were to be disposed on the top surface 104, the clamp would have to be positioned above the table 100 and in the way of the other components. Additionally, if the clamp were to contact the top surface 104 (i.e. if the top surface 104 operates as one of the first and second clamping sides 124*a*, 124*b*), then the top surface 104 cannot have an elastic layer 128; the presence of an elastic layer 128 on the top surface 104 would render the top surface 104 inconsistent and not flat, which would interfere with the movement of the bag 1 along it, as well as increase irregularity of the surface that provides more edges for the bag 1 to catch on and become damaged or creased. If, for example, the top surface 104 does not have an elastic layer 128, then the clamp may damage the bag 1 when the clamp is closed due to the more rigid material of the top surface 104 and the pressure generated by the clamp required to hold the bag 1 in place. As such, it may be advantageous in some aspects to have the clamp 124 disposed in or adjacent to the slot 120 and to have the bag 1 be introduced into the slot 120 while the top surface 104 remains substantially flat and consistent.

The adjustable table assembly 10 allows for easier access to the table 100 for the operator during loading of the bags 1. A series of rails are disposed in the assembly that allow for movement of components. Referring again to FIGS. 1-4, a pair of fixed rails 140 are fixedly attached to the filler assembly 3. A pair of sliding rails 144 slidably contacts the pair of fixed rails 140. Each of the sliding rails 144 is configured to slide along or a respective fixed rail 140. The sliding rails 144 are attached to the table 100. Thus, the table 100 may be slidably moved along the fixed rails 140 along a first axis A1. In a loading position, the table 100 is moved at least partly out of the filler assembly 3 towards the operator (not shown), who can then feed the bags 1 onto the table 100. When the placement of the bags 1 is complete, the table 100 may then be slidably moved into the operating position back inside the filler assembly 3 away from the operator. The distance that the table 100 may be moved is dictated by the available space in the manufacturing facility, the size of the bags 1 used, and the specific feeding process by the operator. The fixed rails 140 and/or the sliding rails 144 may also include physical stops (not shown) to prevent movement of the table 100 beyond a predetermined position. In some aspects, a handle 170 may be disposed on the table 100 or on the sliding rails 144 for the operator to use to pull the table 100 into the loading position and to push the table 100 into the operating position. Although two sets of rails are depicted (i.e. the fixed rails 140 and the sliding rails 144), it will be appreciated that more sets of rails can be utilized to achieve the same arrangement and movement capability of the table 100.

Figure 4:
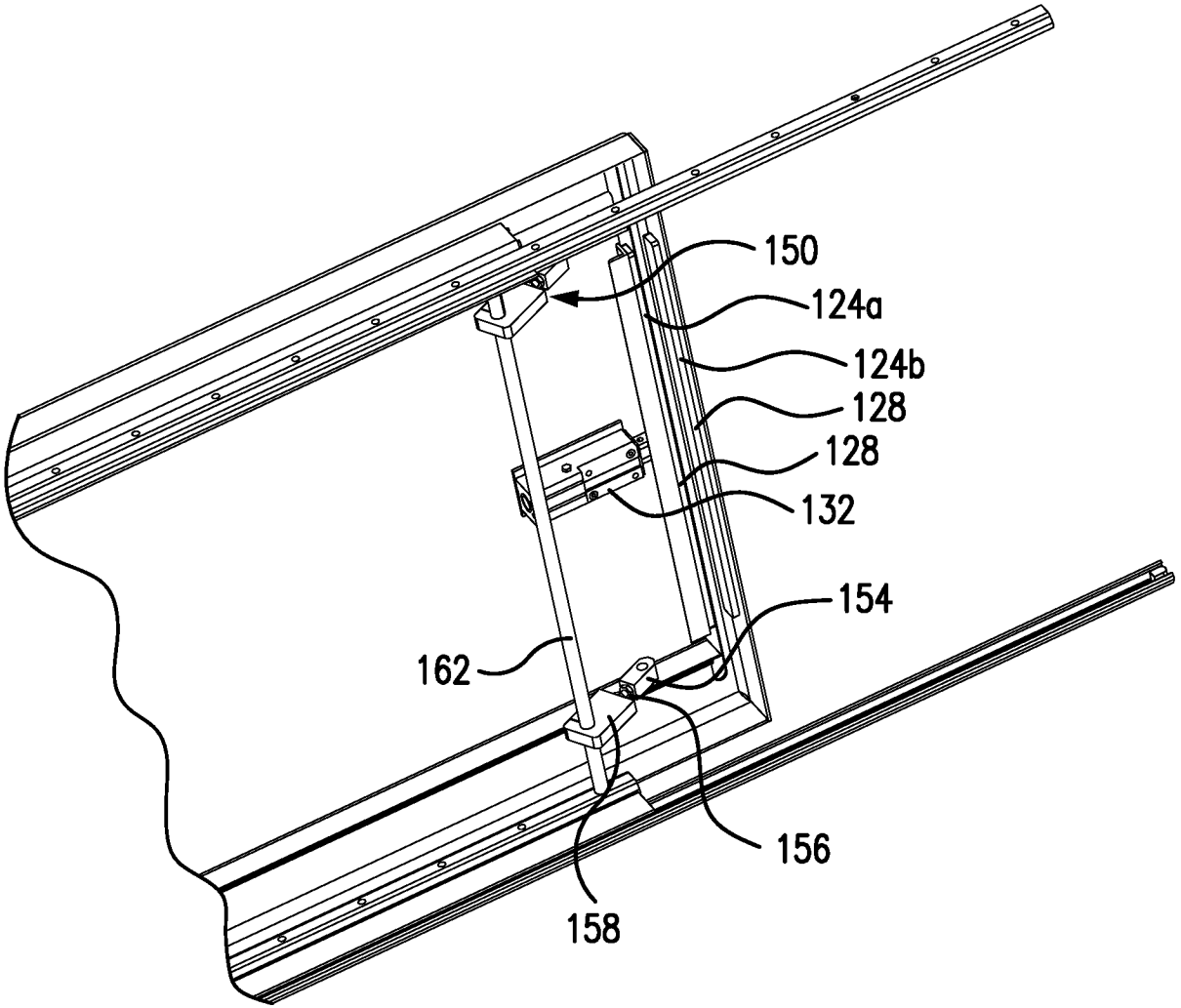
FIG. 4 depicts an isometric view of a portion of the adjustable table assembly of FIGS. 1-3.

In some aspects, the adjustable table assembly 10 may be configured to change the relative height of the table 100 (e.g. relative to the floor or the operator) along a second axis A2. In some aspects, for example, the second axis A2 may be substantially perpendicular to the first axis A1. A height adjustment assembly 150 may be disposed on the table 100 or on the rails 140, 144. Referring to FIG. 4, the height adjustment assembly 150 may include a first head 154 that is fixedly attached to the table 100 and a second head 158 that is fixedly attached to the sliding rail 144. The first head 154 and the second head 158 may be connected to each other by an adjustable and movable connector 156 that can be moved to change the distance between the first and second heads 154, 158, for example, a screw, an adjustable rod, a step-wise or incremental engagement, or another suitable mechanism for moving the first and second heads 154, 158 towards or away from each other and securing them in the desired positions. The greater the distance between the first and second heads 154, 158, the higher the table 100 may be positioned. Conversely, to lower the table 100, the distance between the first and second heads 154, 158 can be decreased.

It will be appreciated that the height adjustment assembly may include a plurality of first heads 154 and a plurality of second heads 158 that engage with respective first heads 154 (e.g. four first heads 154, with one at each corner of the table 100). The second heads 158 may attach directly to the sliding rails 144, or, as depicted in aspects shown in FIG. 4, the second heads 158 may attach to a transverse rod 162 that is in turn fixedly connected to the sliding rails 144.

Figure 12:
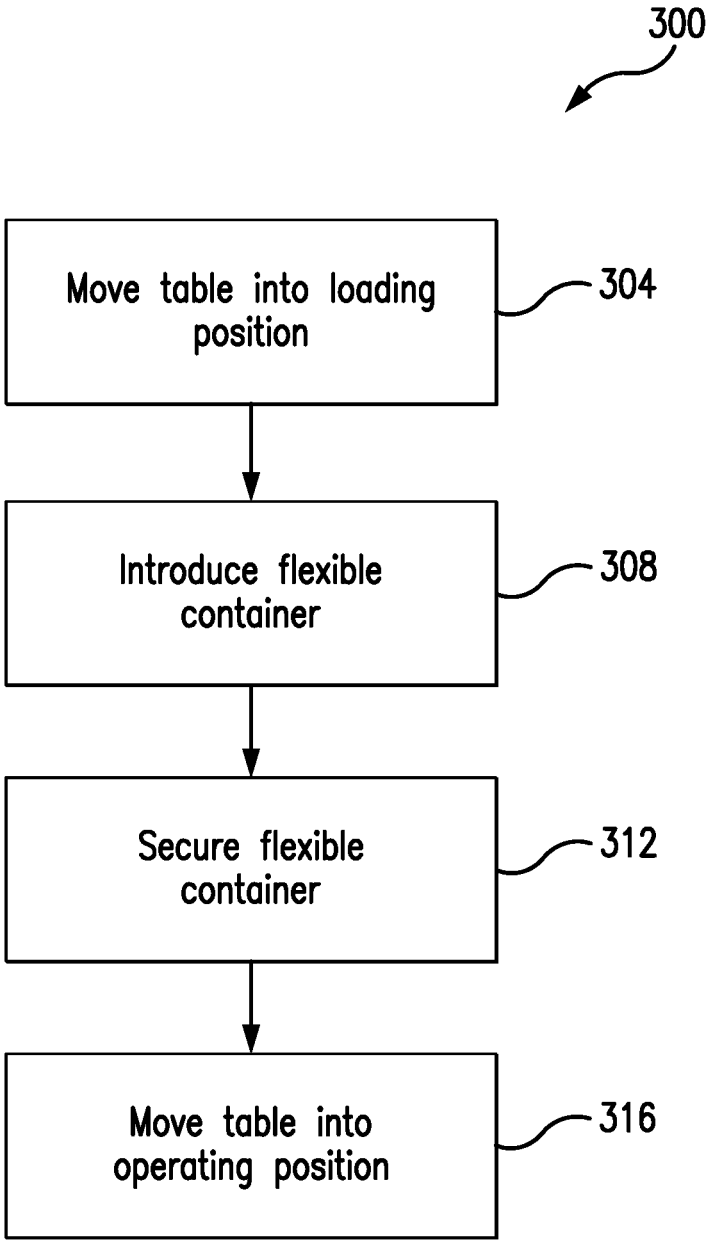
FIG. 12 depicts a flow chart showing a process of feeding a flexible container into the adjustable table assembly according to an aspect of the disclosure.

FIG. 12 depicts a process 300 for loading the bags 1 onto the adjustable table assembly 10. In step 304, the operator moves the table 100 into the loading position. The table 100 is pulled along the rails 140, 144 out of the filler assembly 3 so that the operator can access the top surface 104 without reaching into the filler assembly 3.

In step 308, the operator introduces the bag 1 onto the table 100, such that the bag 1 lies flat on the top surface 104. The bag 1 may contact the front face 116 and/or the edge 118. In some aspects, where a plurality of bags 1 is used, the operator introduces the first of the plurality of bags 1 and arranges the rest of the bags (e.g. in connected sheets or in a roll) such that they can easily be moved into the filler assembly 3 when the automated process begins.

In step 312, the operator inserts a portion of the bag 1 into the slot 120 to secure it. The clamp 124 may be actuated to hold the bag 1 in place. If the clamp 124 is automatically actuated, it moves into the closed configuration when the operator inserts the bag 1 into the slot 120. If the clamp 124 is manually actuated, then the operator actuates that clamp 124 to close after inserting the bag 1 into the slot 120. The actuation can be done by moving the clamp 124 or electronically by pushing a button.

In step 316, after the bag 1 is disposed in the desired orientation and secured in the slot 120, the operator moves the table 100 into the operating position by sliding the table 100 along the rails 140, 144 back inside the filler assembly 3. Once the table 100 is inside the filler assembly 3, the operator no longer needs to reach inside the filler assembly 3, which further decreases chances of injury or damage to the components.

When the table 100 is in the operating position, the filler assembly 3 may be actuated to perform all of the necessary steps described above. The bags 1 that are loaded into the adjustable table assembly 10 may be moved along the table 100 towards the filling components.

In some aspects, optional steps may be taken before, during, or after the process described above. If the height of the table 100 needs to be adjusted, this may be done by the operator by moving one of the first and second heads 154, 158 towards the other of the first and second heads 154, 158 (to lower the table 100) or away from the other of the first and second heads 154, 158 (to raise the table 100).

The filler assembly 3 further includes a pusher 200 configured to contact the bag 1, for example at the bag's spout 2, and move the bag 1 along the table 100 and towards the other components of the filler assembly 3. To facilitate keeping the bag 1 in the desired orientation, an adjustable rail assembly 201 may be configured to movably be placed on top of or adjacent to the bag 1 when the bag is on the table 100. The adjustable rail assembly 201 includes two rails 204 that are substantially parallel to each other and that define a space 212 therebetween. The space 212 is dimensioned to receive the spout 2 of the bag 1. The rails 204 act as guides for the spout 2 and to the attached bag 1. The two rails 204 are positioned at a distance d away from each other. The distance d may be changed in order to accommodate a differently sized spout 2. It will be appreciated that the distance d should be nominally greater than the diameter of the spout 2, but small enough that the spout 2 can be guided along the rails 204. The parallel rails 204 may be shaped such that the two rails 204 are parallel for a portion thereof, but are splayed outward at an end thereof where the spout 2 of the bag 1 is configured to enter the space 212. This splaying may allow for a wider mouth to capture the spout 2 as the bag 1 is moved towards and into the space 212.

Figure 5:
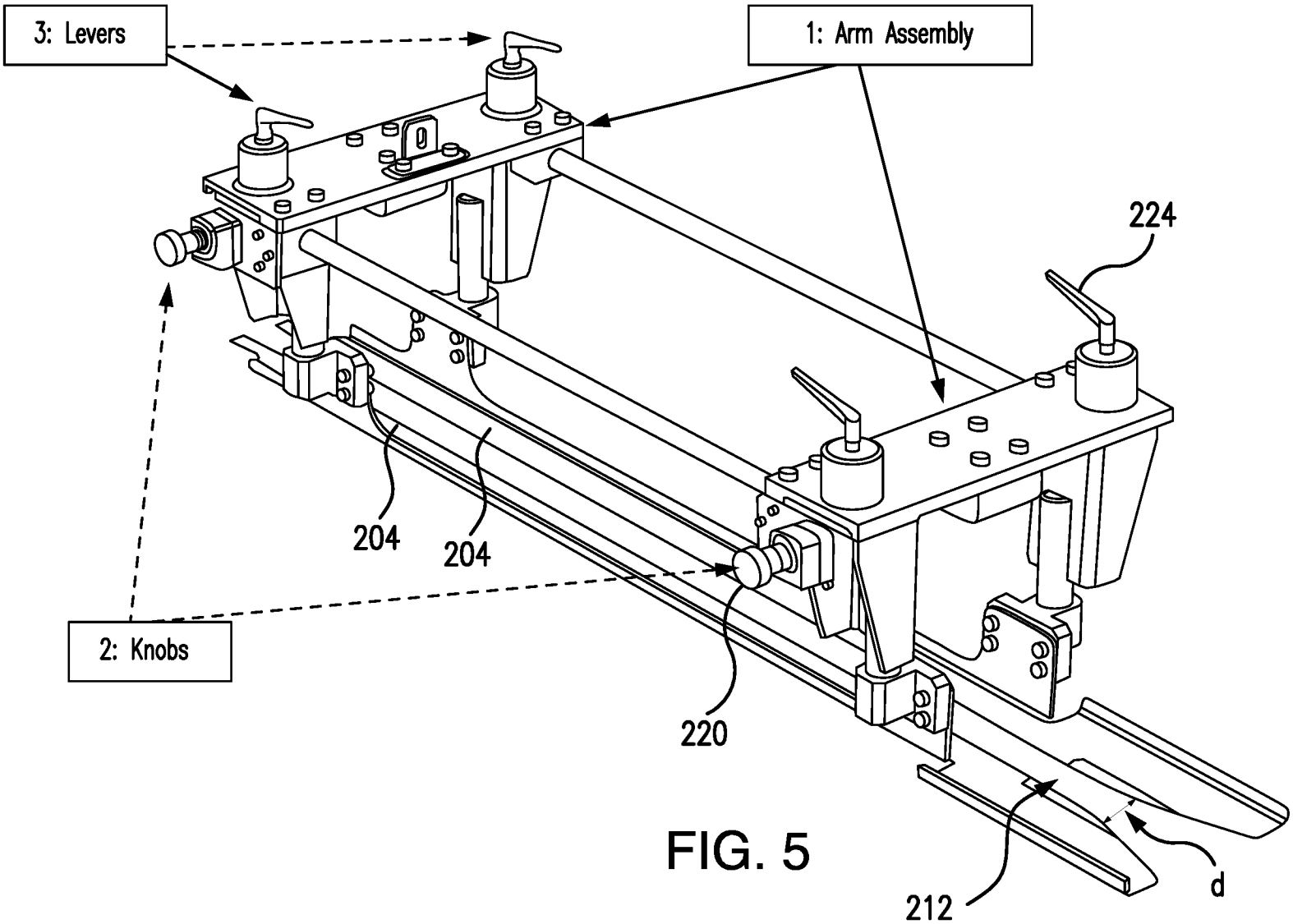
FIG. 5 depicts an adjustable rail assembly according to an aspect of the disclosure.
Figure 6:
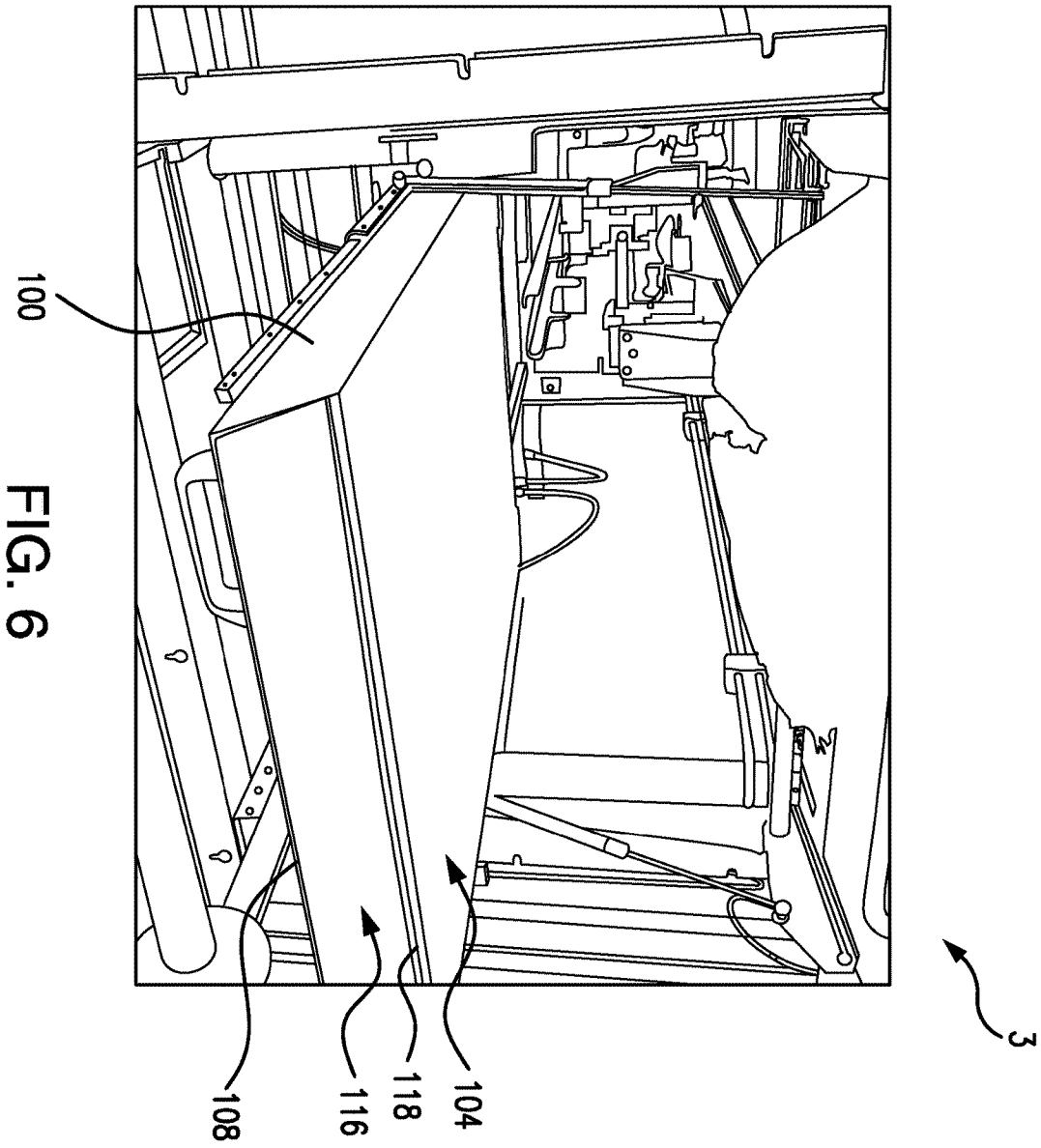
FIG. 6 depicts a filler assembly with an adjustable table assembly according to an aspect of the disclosure.
Figure 7:
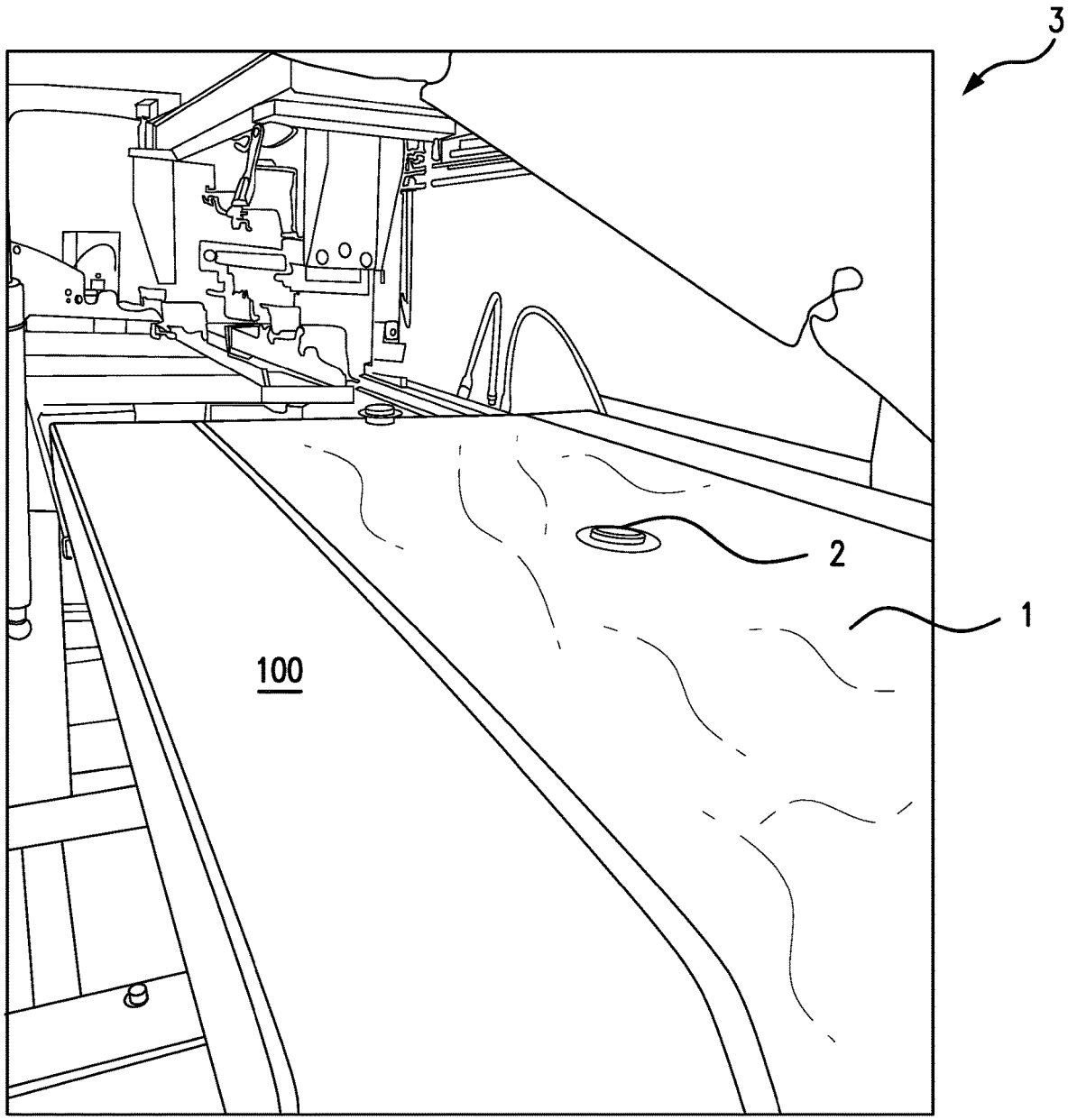
FIG. 7 depicts a filler assembly with a flexible container according to an aspect of the disclosure.
Figure 8:
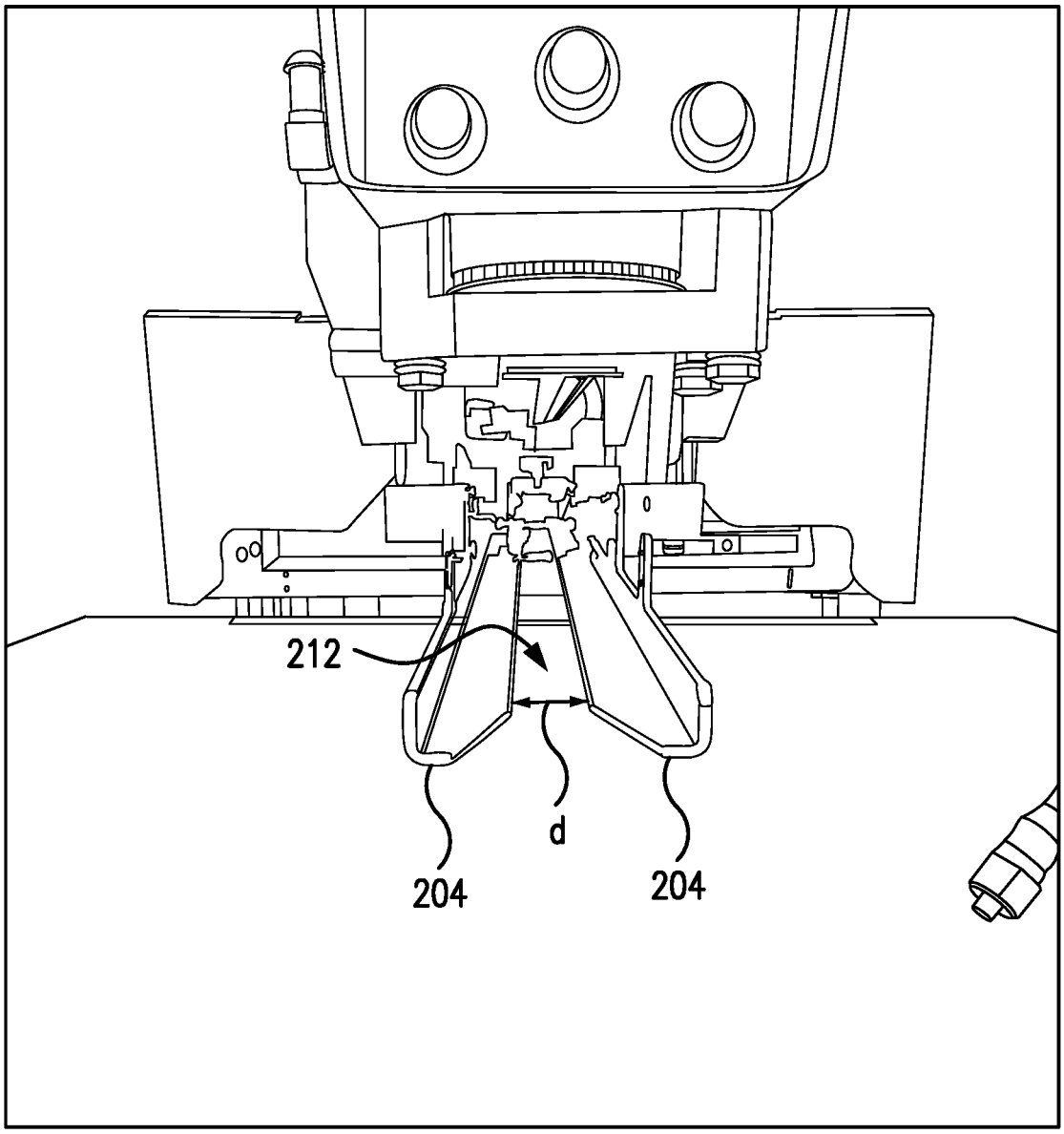
FIG. 8 depicts a filler assembly with an adjustable table assembly and an adjustable rail assembly according to an aspect of the disclosure.
Figure 9:
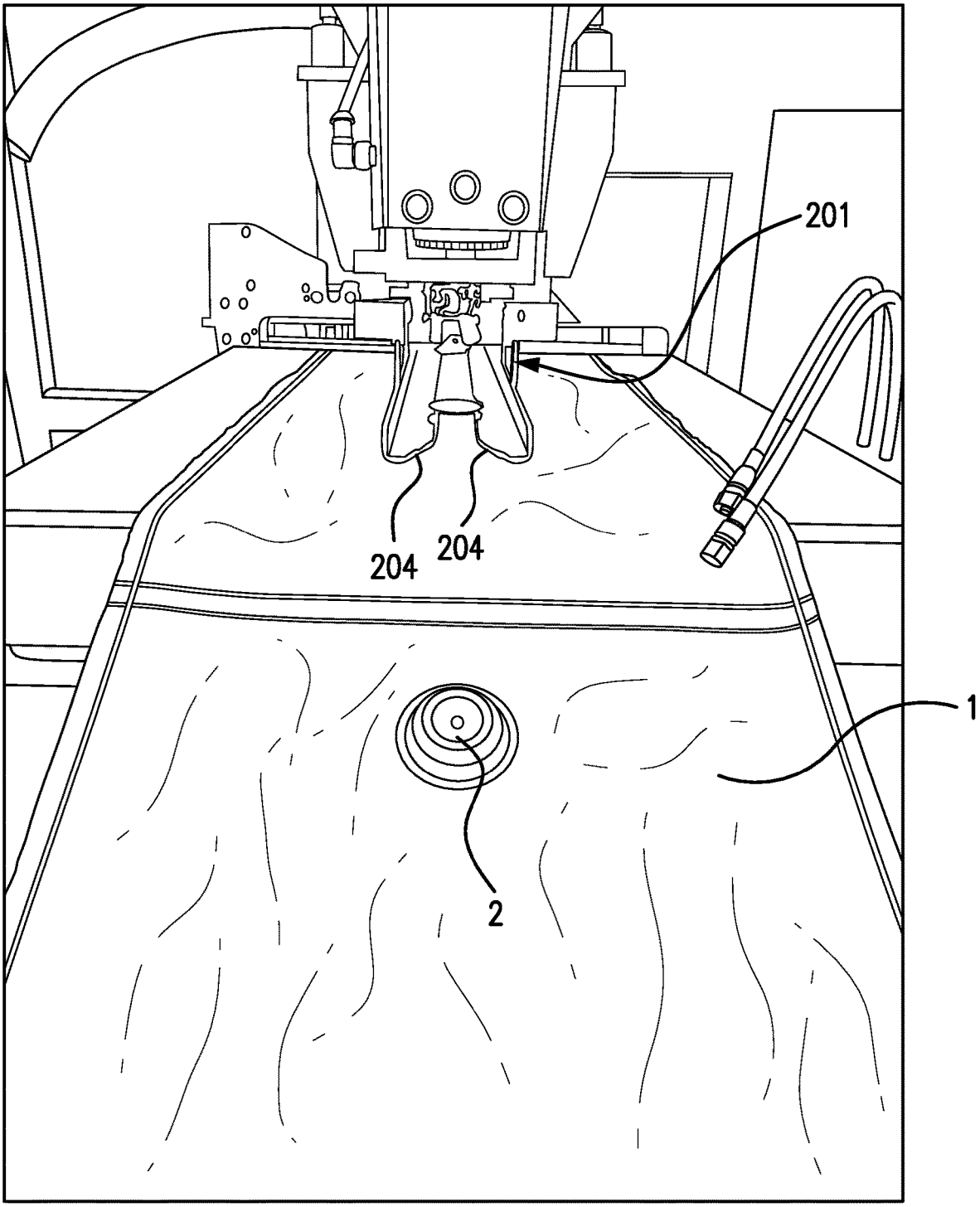
FIG. 9 depicts a filler assembly with an adjustable table assembly and an adjustable rail assembly and with a flexible container according to an aspect of the disclosure.
Figure 10:
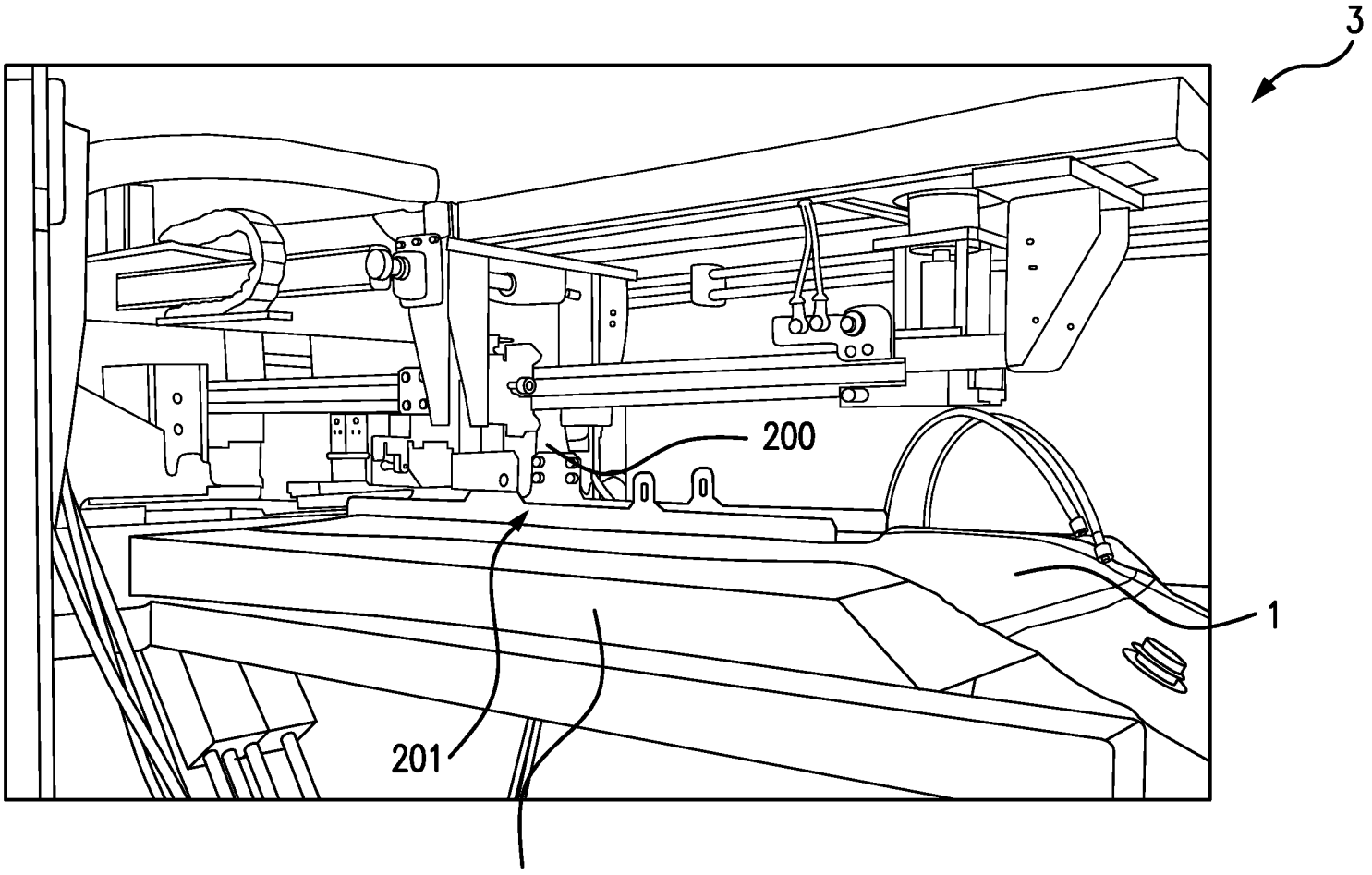
FIG. 10 depicts a filler assembly according to an aspect of the disclosure.
Figure 11:
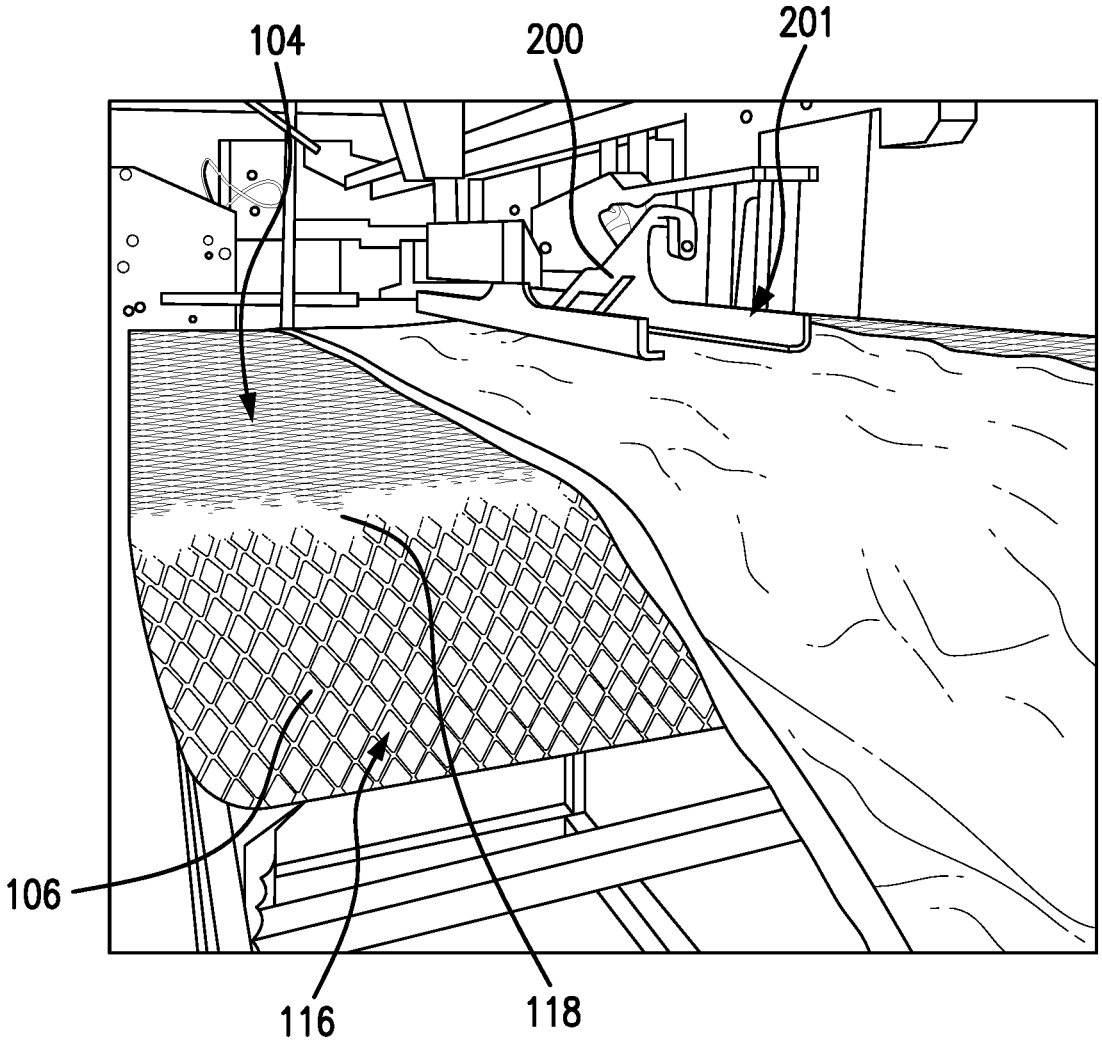
FIG. 11 depicts an adjustable table assembly according to another aspect of the disclosure.

The distance d may be adjusted by moving one or both of the rails 204 towards or away from each other. For example, in some aspects as shown in FIG. 5, one or more knobs 220 may be rotated to move the one or both rails 204; rotating the knob 220 in a first direction may move the one or both rails 204 closer to each other, while rotating the knob 220 in a second direction opposite the first direction may move the one or both rails 204 away from each other. In some aspects, the position may be secured with a releasable lever 224. The adjustable rail assembly 201 may be movable within the filler assembly 3 such that it can be moved away from the table 100 when the bag 1 is being loaded and then moved towards the table 100 when the table 100 is in the operating position. The pusher 200 may be configured to contact the bag 1, for example at the spout 2, and to push it in the desired direction. The position, orientation, and flat arrangement of the bag 1 may be maintained while the pusher 200 is moving the bag 1 by the presence of the adjustable rail assembly 201 to guide the bag 1. When the pusher 200 is configured to begin moving the bag 1, the clamp 124 may be actuated to move to the open configuration, thus releasing the bag 1. As the pusher 200 pushes the bag 1 along the table 100, the portion of the bag 1 that was inserted into the slot 120 exits the slot 120.

FIGS. 6-10 depict aspects of filler assemblies 3 that include adjustable table assemblies 10 and, optionally, the pusher 200 and/or the adjustable rail assembly 201.

The depicted auto-feed assembly allows for the flexible container (e.g. the bag 1) to be pre-fed into the system. The flexible container is introduced into the auto-feed assembly, and the auto-feed assembly is configured to move the flexible container through the modular filler machine to the pusher assembly. This eliminates the need to manually feed the flexible container through the inconvenient portions of the system.

The auto-feed assembly can be translated and/or rotated within the modular filler assembly such that the auto-feed assembly can be engaged at any of the inlets into the modular filler assembly. The auto-feed assembly is configured to receive the flexible container (e.g. flexible bag, such as a bag used in the Bag-in-Box industry) and to move the flexible container to its desired position within the modular filler assembly.

The auto-feed assembly can be configured to automatically position the flexible container based on the flexible container's parameters (e.g., size, thickness, material, spout, etc.). The automation can be actuated either by a predetermined program or recipe received from a controller interface, or from another method of instructing the auto-feed assembly to move.

Movement of the auto-feed assembly can be accomplished by a motor, such as, but not limited to, servo motor, stepper motor, linear motor, A/C motor, DC motor, air motor, pneumatic actuator, hydraulic actuation linear positioning encoder, nip drive roller, or another suitable mechanism for actuating movement.

While systems and methods have been described in connection with the various embodiments of the various figures, it will be appreciated by those skilled in the art that changes could be made to the embodiments without departing from the broad inventive concept thereof. It is understood, therefore, that this disclosure is not limited to the particular embodiments disclosed, and it is intended to cover modifications within the spirit and scope of the present disclosure as defined by the claims.

What is claimed:

1. An adjustable table assembly for use in a filler assembly, the adjustable table assembly comprising:

a table having a top surface configured to receive a flexible container thereon, the table having an infeed end and an outfeed end opposite the infeed end and a slot defined in the top surface of the table that is generally parallel to the outfeed end; and a clamp disposed on the table and configured to releasably secure the flexible container to the table;

wherein the table is movable along a plurality of rails affixed to the filler assembly, the table being movable between a loading position, in which the table is configured to receive the flexible container, and an operating position, in which the table is inside the filler assembly, the movement of the table along the plurality of rails being along a first axis.

2. The adjustable table assembly of claim 1, wherein the slot is configured to receive the flexible container therein, wherein the clamp is disposed underneath the top surface of the table and is configured to releasably secure the flexible container in the slot.

3. The adjustable table assembly of claim 1, wherein the flexible container is a bag having a spout extending therefrom.

4. The adjustable table assembly of claim 1, wherein the top surface defines a dimpled textured thereon.

5. The adjustable table assembly of claim 1, wherein the clamp has an open configuration in which the flexible container is not secured therein and a closed configuration in which the flexible container is secured in the clamp, wherein the clamp includes a first clamping side, a second clamping side opposite the first clamping side, and an actuator, wherein the actuator is configured to move at least one of the first and second clamping sides towards the other of the first and second clamping sides when the clamp is moved into the closed configuration, and away from the other of the first and second clamping sides when the clamp is moved into the open configuration.

6. The adjustable table assembly of claim 5, wherein the first clamping side and the second clamping side each include an elastic layer thereon, the elastic layers on each of the first and second clamping sides being configured to contact the flexible container when the clamp is in the closed configuration.

7. The adjustable table assembly of claim 1, further comprising a height adjustment assembly configured to be actuated to move the table along a second axis that is perpendicular to the first axis.

8. The adjustable table assembly of claim 7, wherein the height adjustment assembly includes a plurality of first heads fixedly attached to the table, a plurality of second heads fixedly attached to the plurality of rails, and a connector attached to both the first and second heads, wherein the connector is configured to be moved such that the first and second head are movable closer to each other or farther from each other.

9. The adjustable table assembly of claim 1, wherein the table defines a front face at the infeed end, the front face being connected to the top surface at an edge.

10. The adjustable table assembly of claim 9, wherein the front face is rounded.

11. The adjustable table assembly of claim 9, wherein the edge is rounded to have a curvature radius of between 0.25 inches and 5 inches.

12. The adjustable table assembly of claim 1, wherein the clamp is disposed closer to the outfeed end of the table than to the infeed end.

13. The adjustable table assembly of claim 1, further comprising an adjustable rail assembly configured to guide the flexible container along the table, wherein the adjustable rail assembly includes two parallel rails that define a space therebetween, the space being configured to receive the flexible container therein.

14. The adjustable table assembly of claim 13, wherein the adjustable rail assembly is configured to change the space between the two parallel rails, wherein at least one of the two parallel rails is configured to be moved to change the dimensions of the space between the two parallel rails.

15. A filler assembly for moving a flowable material into a flexible container, the filler assembly comprising an adjustable table assembly of claim 1.

16. The adjustable table assembly of claim 1, further including a plurality of sliding rails affixed to the table that slidably move along the plurality of rails affixed to the filler assembly.

17. A method of feeding a flexible container into a filler assembly using an adjustable table assembly having a table and a clamp, the method comprising:

moving the table along a first axis in a first direction into a predetermined loading position;

introducing the flexible container at an infeed end of the table and onto a top surface defined on the table;

moving the flexible container into a slot defined on the top surface;

securing the flexible container in the slot with a clamp disposed on the adjustable table assembly; and moving the table along the first axis in a second direction opposite the first direction and into a predetermined operating position.

18. The method of claim 17, wherein the clamp secures the flexible container underneath the top surface of the table.

19. The method of claim 17, further comprising moving the table along a second axis perpendicular to the first axis when the table is in the predetermined loading position.

20. The method of claim 17, further comprising actuating operation of the filler assembly after moving the table into the predetermined operating position.

21. The method of claim 17, further comprising positioning at least one safety guard adjacent to the adjustable table assembly after moving the table into the predetermined operating position.

22. The method of claim 17, further including providing a sliding rail attached to the table and sliding the sliding rail along a rail affixed to the filler assembly.

* * * * *